United States Patent [19]

Cole

[11] 3,948,169

[45] Apr. 6, 1976

[54] COAXIALLY MOUNTED STENCIL DRUM AND RUBBER MAT ROLLER SEGMENTS

[75] Inventor: Jean R. Cole, Des Plaines, Ill.

[73] Assignee: Weber Marking Systems, Inc., Arlington Heights, Ill.

[22] Filed: Nov. 14, 1974

[21] Appl. No.: 523,659

[52] U.S. Cl. ..... 101/116; 101/125; 101/128.1; 101/329; 101/333; 101/375

[51] Int. Cl.[2].. B41F 15/02; B41F 15/38; B41F 5/02

[58] Field of Search ..... 101/116, 117, 375, 376, 101/125, 48, 49, 90, DIG. 22, 327, 328, 329, 333, 112, 129, 127, 127.1, 128.1; 29/125, 130, 131

[56] References Cited

UNITED STATES PATENTS

| | | | |
|---|---|---|---|
| 671,634 | 4/1901 | Saunders | 101/117 |
| 1,470,644 | 10/1923 | Reoch | 101/375 |
| 1,542,577 | 6/1925 | Phipps | 101/48 X |
| 1,909,912 | 5/1933 | Elliot | 101/116 X |
| 2,054,152 | 9/1936 | Wood | 101/122 |
| 3,678,848 | 7/1972 | Roser et al. | 101/125 |
| 3,693,545 | 9/1972 | Kondur Jr. | 101/375 |

*Primary Examiner*—Edgar S. Burr
*Assistant Examiner*—R. E. Suter
*Attorney, Agent, or Firm*—Kenneth T. Snow

[57] ABSTRACT

A cylindrical printing roller combining a rubber mat printer and a stencil printer. The rubber mat portion is inked externally while the stencil portion receives its ink from internally of the roller. The two printing forms on the roller print simultaneously.

5 Claims, 2 Drawing Figures

COAXIALLY MOUNTED STENCIL DRUM AND RUBBER MAT ROLLER SEGMENTS

BACKGROUND OF THE INVENTION

1. Field of the Invention

Industry uses many shipping and other types of labels. In the past these labels have generally been printed by specialty label printing companies with an address space left for inserting the name of the addressee. This is done either by typing on the preprinted label or if there are many labels to be made for the same recipients then this is usually done by a stencil printing process. One of the next steps in label development was to have an all stencil printed label but the resultant labels did not favorably compare in aesthetic appearance to the partially preprinted labels. A succeeding stage in label development was to have stencils factory die-cut for those portions that would have been preprinted on earlier labels. This started to approach the quality of preprinted labels. A further step in label development was to employ a silk screen for the printed matter which was to be common to all the labels and then have a replaceable stencil for the other portion. Still more recently, companies, both large and small, have been printing their own labels with machines which as a rule employ rubber mat printing systems. However, this is again all factory pre-cut rubber mats and the users must employ a second means to effect an addressing of the labels they have made. Again, typing or stencil imprinting is usually the means employed to complete the addressing or other marking of the label.

It is the purpose of the present invention to retain the printing quality of the rubber mat type of printing for the repetitive portion of the label and concurrently employ a stencil printing of the changing portion of the label. No one heretofore has in a single operation printed labels or tags or the like with a rubber mat and a stencil.

2. Description of the Prior Art

The early U.S. Pat. Nos. to J. R. Thomas 2,713,304 and 2,866,258 show stencil printing machines primarily designed for label printing by the use of stencils. The French Patent to Picard 830,499 which issued in 1938 shows and describes a stencil which has its upper portion die-cut with indicia it is desired to print repetitively on all stencils while the bottom portion is left uncut so the user may insert by other means, such as a typewriter, that portion of the text which will be changed. The U.S. Pat. No. to Berkland 3,277,819 shows a hand printer in which the upper portion is provided with a silk screen for repeating the repetitious part of a label, such as the shipper's name and address. The lower portion of the Berkland hand stamp is provided with a removable stencil so that different addressees names may be applied thereto by a typewriter of the like.

SUMMARY OF THE INVENTION

A principal object of the present invention is to provide a novel printing roller having combined rubber mat printing and stencil printing.

An important object of this invention is to provide a novel printing roller which simultaneously imprints from the same outer cylindrical surface a precut rubber mat and a pre-cut stencil.

Another important object of this invention is to provide a novel printing roller having a first cylindrical portion carrying a rubber mat for imprinting and an axial aligned and side-by-side second cylindrical portion carrying a stencil for imprinting.

Still another important object of this invention is to provide a device as defined in the preceding object in which the first cylindrical portion is of slightly lesser diameter than the second cylincrical portion to compensate for the rubber mat being thicker than the stencil.

Another and still further important object of this invention is to provide a stencil imprinting roller and a separate rubber mat imprinting roller with means for mounting both rollers on a single shaft in side-by-side relationship.

Still another important object of this invention is to provide a device as defined in the preceding object and having novel means for locking the stencil imprinting roller and the rubber mat imprinting roller in fixed arcuate alignment.

A still further important object of this invention is to provide a novel means for externally inking a rubber mat printing roller which is aranged in side-by-side relationship with a stencil imprinting roller having internal inking means.

Other and further important objects and advantages will become apparent from the disclosures in the accompanying drawings and following specification.

IN THE DRAWINGS

AS SHOWN IN THE DRAWINGS

Figures 1, 2:
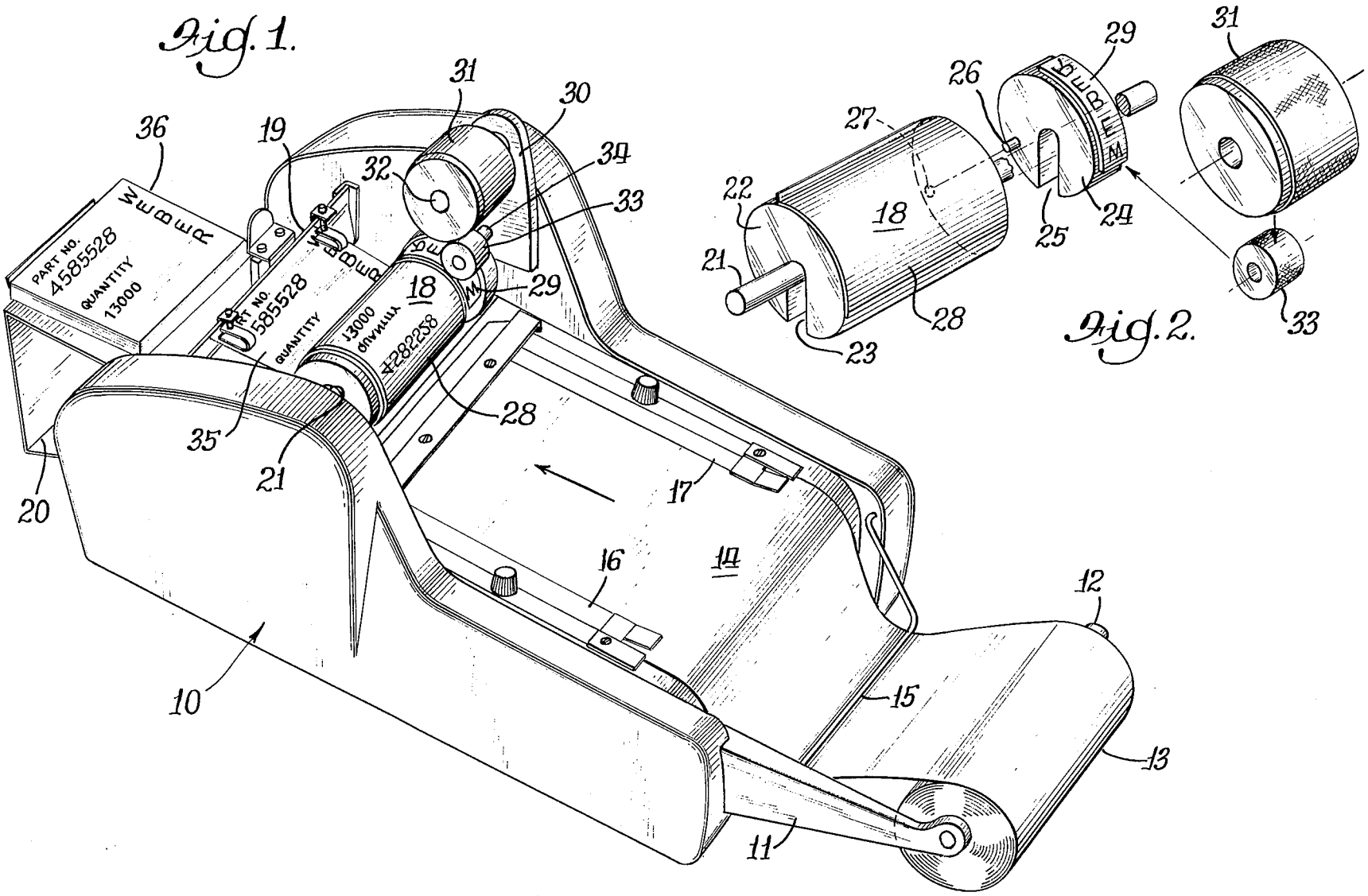
FIG. 1 is a perspective view of a label printing machine embodying the novel printing cylinder of this invention.
FIG. 2 is an exploded view of the elements comprising the printing cylinder and its inking mechanism.

The reference numeral 10 indicates generally a label printer housing. It is in such a label printer that the printing cylinder embodiment of this invention is used to effectively produce quality labels or tags with desired indicia. The housing 10 includes a cantilever arm 11 projecting forwardly therefrom. The front end of the arm 11 carries a transverse shaft 12 on which a roll of label paper stock 13 is carried.

A strip 14 from the roll of paper 13 passes into the label printer, first passing under an idler bar 15 which puts a slight tension on the paper strip 14 and thence rearwardly between and under laterally spaced apart and longitudinally extending paper guides 16 and 17. The paper strip 14 then passes beneath a printing cylinder designated generally by the numeral 18. When passing beneath the cylinder the indicia contents of the cylinder are transferred to the paper 14. An adjustable knife 19 located rearwardly of the cylinder 18 in the housing 10 is utilized to cut off the labels being printed to any desired length. After being cut, the labels are discharged by falling into a tray and catch 20 positioned at and on the rear of the housing 10.

The printing cylinder 18 and its particular construction constitutes the novel inventive feature of the present invention. The cylinder comprises a shaft 21 which supports the cylinder in a transverse position in the spaced apart side walls of the housing 10. The shaft 21 is shown both in FIG. 1 and in the exploded view of FIG. 2. The cylinder 18 is composed of a first cylindrical part 22, which for convenience will be designated as the stencil printing part of the cylinder. The cylindrical first part 22 is provided with a radial slot 23 to provide for quick and easy mounting on the shaft 21. The means for locking the cylinder part on the shaft has not been shown in detail here but is shown in the prior U.S. Pat. No. to J. R. Thomas 2,866,258. The cylinder also comprises a second cylindrical part 24, which for convenience will be designated as the rubber mat printing part of the cylinder. Again, this cylindrical part 24 is provided with a radial slot 25 which permits ready mounting thereof on the shaft 21 by means such as shown in the earlier Thomas patent.

A pin 26 is provided on the second cylindrical part 24 and projects in an axial direction toward the first cylindrical part 22. A cooperative socket 27 on the end of the first cylindrical part 22 is adapted to receive the pin 26 when the combination roll parts 22 and 24 are in snug, side-by-side relationship. The cooperative pin and socket 26 and 27 keeps the cylinder parts 22 and 24 in fixed arcuate relationship during the printing process and thereby insures that the printing indicia on both parts will always be properly oriented one to the other.

A pre-cut stencil 28 is mounted over the first cylinder part 22. The cylinder part 22 is generally hollow for the reception of stencil printing ink. The cylinder has a perforated outer cover which is usually covered with a felt pad for dispersal of the ink over the full stencil 28. Although most of the structural details of the stencil cylinder 22 are not shown in the accompanying drawings the contruction has been used for some time and is depicted in the Vosburg et al U.S. Pat. No. 3,844,212. Thus the cylinder part 22 is self sufficient to provide ink for the outer stencil 28 and cause indicia cut in the stencil to be transferred to the paper strip 14 as that paper passes beneath the cylinder 18 when that cylinder is rotated by means not shown. The ink comes from the interior of the cylinder part 22 and thence out through the cut portions of the stencil to be imprinted on the receiving label paper.

A rubber printing mat 29 is provided on the cylinder part 24 as best shown in both of FIGS. 1 and 2. Such a rubber mat printing device on a cylinder is shown in the prior Roser U.S. Pat. No. 3,735,700. Although this has been constantly referred to as a rubber mat printer it should be understood that the technical name for such a mat printer is flexographic. Also, when the word "rubber" is used it is meant any elastomer including natural rubber, synthetic rubber or plastic materials having characteristics desirable for a flexographic mat. Although the printing from the stencil is generally quality printing it does not compare with the printing from a finely made rubber mat. Thus, the rubber mat portion of the printing cylinder is used to print the relatively fixed indicia of the labels or tags being imprinted.

An upwardly extending bracket 30 is mounted on and carried on one side of the label printer housing 10. The bracket 30 carries an inking cylinder 31 near its upper end for free journaling rotation on a shaft 32 which extends from a fixed position in the bracket 30 over the printing cylinder 18 and particularly that portion of the cylinder comprising the cylindrical rubber mat carrying portion 24. The inking roll 31 is charged with ink and is in rolling contact with an ink transferring roller 33. Thus, ink passes from the inking roller 31 to the transfer roller 33 which is also carried on the bracket 30 by means of a shaft 34 disposed generally parallel to and beneath the shaft 32. The transfer roller 33 has rolling contact with the cylindrical portion 24 of the cylinder 18 and imparts ink to the outer surface of the indicia or design cut in the rubber mat 29. There is thus provided a combination printing cylinder having a stencil portion which receives its ink supply from the interior of the cylinder and a rubber mat portion which receives its ink exteriorly of the cylinder. Yet, when label paper web stock is delivered under the combination printing roller 18, indicia from both forms of printing are imprinted simultaneously on the paper.

The diameter of the second cylinder part 24 is slightly less than the diameter of the first cylinder part 22 to thus compensate for the greater thickness of the rubber mat 29 over the stencil 28. This provides that the outer surfaces of the covered cylinder parts 22 and 24 lie in the same circular plane for the imprinting of labels. Usually the rubber mat has substantially greater thickness than the stencil and this is the reason for having the rollers 22 and 24 of slightly different diameters.

As best shown in FIG. 1 there is a printed portion 35 of the paper strip 14 immediately rearwardly of the printing cylinder 18. This printed portion 35 has been imprinted with indicia from the stencil portion and the rubber mat portion of the combination printing roller 18. In a continuing operation the knife 19 acts by means not shown to cut off the printed portion of the paper strip 14 in any desired length as determined by the operator. Thereupon the cut labels or tags drop into the receiving tray 20. These labels have both the stencil imprinted portion usually originating with a typewriter and the rubber mat imprinted portion which has been carefully premade for sharp and professional reproduction.

I am aware that numerous details of construction may be varied throughout a wide range without departing from the principles desclosed herein and I therefore do not intend limiting the patent granted hereon otherwise than as necessitated by the appended claims.

What is claimed is:

1. A cylindrical printing roller and ink supply therefore comprising in combination, a shaft, a first cylindrical portion, means mounting said first cylindrical portion in an axial concentric position on said shaft, said first cylindrical portion having a rubber mat printing element mounted on the outer surface thereof, a second cylindrical portion, means mounting said second cylindrical portion in an axial concentric position on said shaft, said second cylindrical portion having a section of its outer surface perforated and having a stencil printing element mounted on the outer surface thereof over the perforated section, said first and second cylindrical portions located in abutting side-by-side relationship on said shaft and together constituting the cylindrical printing roller, roller means for applying ink to said rubber mat printing element, said roller means engaging and having rolling contact with said rubber mat printing element on the outside thereof, and said second cylindrical portion having an ink supply chamber therein for passing ink outwardly through the perforated section and thence through said stencil printing element whereby the cylindrical printing roller may simultaneously print from the rubber mat and the stencil.

2. A device as set forth in claim 1 in which said rubber mat printing element is relatively thick compared to the stencil, said first cylindrical portion of the cylindrical printing roller being of slightly lesser diameter than the second cylindrical portion to compensate for the greater thickness of the rubber mat than the stencil and providing that the outer surfaces of the rubber mat and the stencil are disposed in the same cylindrical plane surface.

3. A device as set forth in claim 1 in which said roller means includes an inking cylinder and a transfer roller whereby the inking cylinder supplies ink to the transfer roller which in turn transfers ink to the rubber mat printing element.

4. A device as set forth in claim 1 in which means is employed for locking said first and second cylindrical portions in fixed arcuate alignment.

5. A device as set forth in claim 4 in which said means for locking comprises cooperative pin and socket means for interconnection between the adjoining side-by-side surfaces of the first and second cylindrical portions.

* * * * *